United States Patent [19]

Cayer

[11] 4,369,929

[45] Jan. 25, 1983

[54] DISPENSER FOR ROLLED SHEET GOODS

[76] Inventor: Pierre W. Cayer, 33 Bungay Ter., Seymour, Conn. 06483

[21] Appl. No.: 218,046

[22] Filed: Dec. 19, 1980

[51] Int. Cl.[3] ..... B65H 19/04

[52] U.S. Cl. ..... 242/55.42; 242/55.54; 225/47

[58] Field of Search ..... 242/55, 55.3, 55.53, 242/55.54, 55.42, 137–138; 225/46, 47, 51, 52, 65; 206/391, 58; 221/309, 310

[56] References Cited

U.S. PATENT DOCUMENTS

| | | | |
|---|---|---|---|
| 1,897,143 | 2/1933 | Powell | 225/52 X |
| 2,630,981 | 3/1953 | Strocco | 242/137.1 X |
| 2,836,292 | 5/1958 | Klein et al. | 206/58 |

FOREIGN PATENT DOCUMENTS

| | | | |
|---|---|---|---|
| 638511 | 12/1978 | U.S.S.R. | 206/391 |

*Primary Examiner*—Leonard D. Christian
*Attorney, Agent, or Firm*—Cifelli, Frederick & Tully

[57] ABSTRACT

A dispenser for rolled sheet goods, such as wax paper, aluminum foil, etc., comprises a housing receiving and enclosing a plurality of rolls of sheet goods in vertical orientation, the housing defining a vertical exit slot for each of the rolls of sheet goods, and stop means at the top of the housing which, upon application of pressure, clamps at least a selected one of the rolls of sheet goods against turning. A desired amount of sheet goods is pulled from the dispenser, pressure applied to the stop means, and the sheet goods tensioned and torn off at the slot. In one embodiment, the housing comprises a square base, four vertical sidewalls upstanding from the base and defining slots therebetween at the corners of the housing, and a lid which rests on the ends of the rolls of sheet goods and can be pressed down to stop the rolls of sheet goods from turning. In another embodiment, the housing comprises an elongated cap having a top and depending sidewalls received on a base, with the stop means comprising either a flexible portion of the top of the elongated cap or floating stops mounted through the cap. Flexible clamps are provided in the slots to hold the edge of the sheet goods, and rounded openings intersect the slots to provide access for grasping the ends of the sheet goods. Metal serrated cutters are mounted in the slots if required to sever the sheet goods.

18 Claims, 8 Drawing Figures

DISPENSER FOR ROLLED SHEET GOODS

BACKGROUND OF THE INVENTION

This invention relates to a dispenser for rolled sheet goods, such as wax paper, aluminum foil and the like, and more particularly relates to a countertop dispenser for a plurality of rolled sheet goods.

A wide variety of rolled sheet goods are used in kitchens. These rolled sheet goods include such items as wax paper, aluminum foil, plastic film wrap, plastic bags, and other paper, foil and plastic goods. Such goods are generally manufactured in continuous sheets and packaged on rolls in elongated rectangular boxes. The boxes generally have a hinged lid, and the end of the sheet goods is extended between the flap of the lid and one side of the box. The goods are unrolled and torn off, either against a sharp edge of the box or against a metal serrated strip provided on one edge of the box for the purpose of cutting the rolled sheet goods.

The boxes containing the rolled sheet goods are stored in kitchen drawers or cabinets and are removed for use. Therefore, the boxes require storage space and add to the general clutter often found in drawers or cabinets. More importantly, the rolled sheet goods are not readily at hand when needed.

SUMMARY OF THE INVENTION

A dispenser for rolled sheet goods according to the invention herein generally comprises a housing receiving at least one and preferably a plurality of rolled sheet goods in vertical orientation, with the housing defining a vertical slot for each roll of sheet goods through which the sheet goods is dispensed, and manually operated stop means, which may be a lid, positioned on the upper end of the housing for releasably engaging the rolled sheet goods to prevent the roll from turning. The desired amount of the sheet goods is drawn from the roll through the slot in the housing, the roll rotating with respect to the stop means. Pressure is then applied manually to the stop means, which engages the roll and prevents it from turning, thereby preventing additional amounts of sheet goods from being dispensed and permitting the sheet goods to be pulled into tensioned condition and torn off at the edge of the slot. The edge of the vertical slot may be sufficiently sharp to cut the rolled goods, or separate the rolled goods along a predetermined tear line thereof, and the slot may be provided with a serrated cutting strip to facilitate cutting of the sheet goods. The vertical slots may also be provided with intersecting semi-circular cutouts to expose the edge of the sheet goods, whereby the sheet goods can be grasped and pulled out of the housing. Lightly tensioned spring clamps may also be provided at or adjacent the slots to hold the end of the sheet goods at the slot for further dispensing.

In one preferred embodiment, the housing is square and defines a vertical slot at each corner, the housing having interior partitions defining four vertical cavities each receiving one roll of sheet goods whereby the rolls of sheet goods are respectively dispensed through the four corner slots. A lid rests on the ends of the rolls adjacent the top of the housing walls and the lid is held in squared position on the top end of the housing by means of a handle extending through a slot opening in the lid, the handle also providing a convenient means for moving the dispenser. The roll of sheet goods rotates as the sheet goods are pulled out, and pressure on the top of the lid clamps the roll between the lid and the bottom of the housing to prevent further dispensing of the sheet goods and permit tensioning and tearing of the sheet goods already dispensed. Another embodiment includes a flexible lid which may be deflected into contact with the rolls to secure the rolls against rotation. In a further embodiment, the housing is in the form of an elongated cap and base, with the rolls of sheet goods being received therein. Floating manually operated stop discs are mounted through the top of the housing and are pressed downwardly to engage and hold the rolls of sheet goods.

The dispensers efficiently store and make readily available a plurality of rolls of sheet goods in an attractive countertop unit.

Accordingly, it is a principal object of the invention herein to provide a dispenser for rolled sheet goods.

It is a further object of the invention herein to provide a dispenser for a plurality of rolls of sheet goods in an attractive unit adapted for countertop use.

It is an additional object of the invention herein to provide a dispenser for rolled sheet goods which is fabricated of few parts with simple construction, and is easy to operate and load.

Other and more specific features and objects of the invention herein will in part be obvious and will in part appear from a perusal of the following description of the preferred embodiments and the claims, taken together with the drawings.

DRAWINGS

The same reference numerals refer to the same elements throughout the various Figures.

DESCRIPTION OF PREFERRED EMBODIMENTS

A dispenser for rolled sheet goods 10 according to the invention herein is illustrated in FIGS. 1–4. The dispenser 10 generally comprises a housing 20 adapted to receive four rolls of sheet goods 12–15 in vertical orientation, including manually operated stop means in the form of a lid 50 which is positioned at the top of the housing 20 and assists in dispensing the desired amount of sheet goods.

Figure 1:
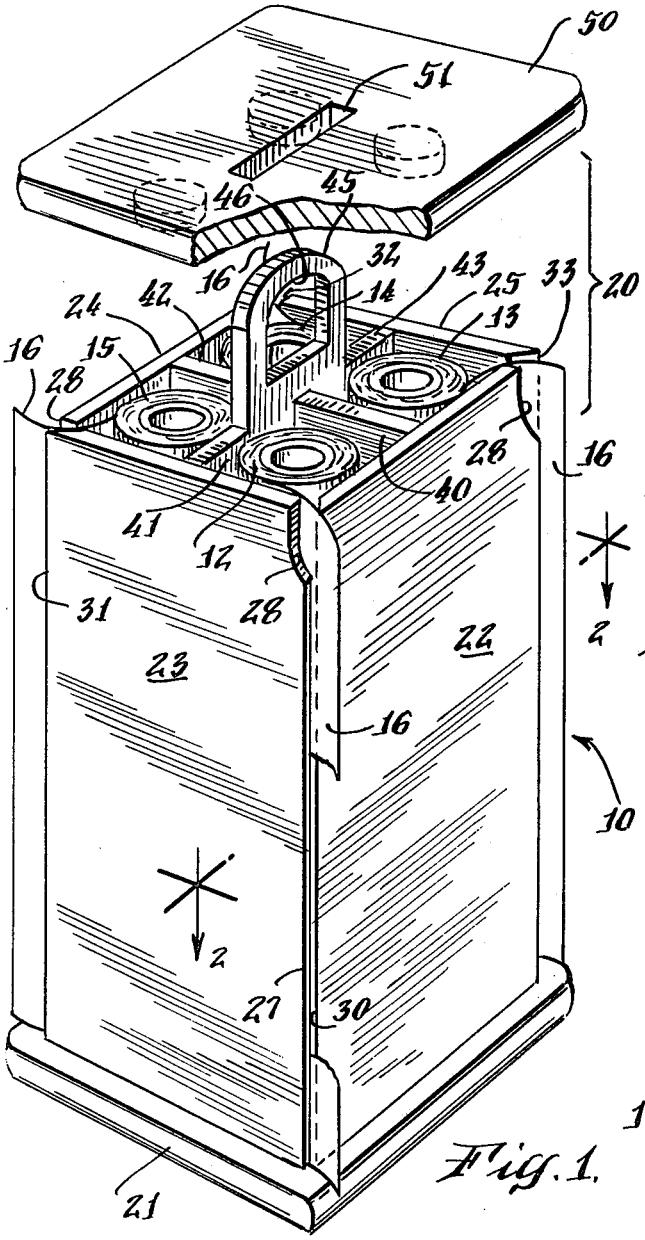
FIG. 1 is a perspective view of a dispenser for rolled sheet goods according to the invention herein.
Figure 2:
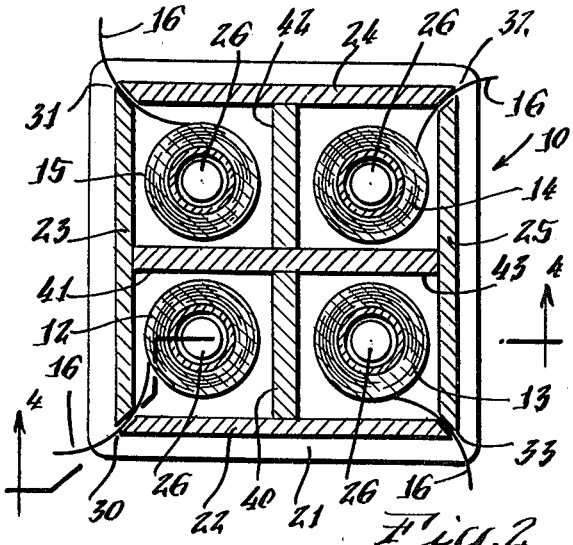
FIG. 2 is a cross-sectional view of the dispenser of FIG. 1 taken along the lines 2—2 of FIG. 1.

The housing 20 of the dispenser 10 comprises a square base plate 21 having rectangular sidewalls 22–25 upstanding therefrom. The sidewalls 22–25 define four vertical slots 30–33 at the corners of the housing 20. More particularly, the vertical side surfaces of the sidewalls 22–25 are reverse beveled at 45°, whereby adjacent side surfaces of adjacent sidewalls are positioned parallel and spaced apart to define the slots 30–33, as best seen in FIG. 2. Interior partitions 40–43 support the sidewalls 22–25 and divide the interior of the housing 20 into four elongated compartments for receiving four rolls of sheet goods 12–15. The base plate 21 is provided with four upstanding stub shafts 26, one stub shaft being centrally located in each compartment for receiving the cardboard tube support of a roll of sheet goods. Partitions 40 and 42 are aligned and extend from the center of sidewall 22 to the center of sidewall 24, and partitions 41 and 43 are also aligned and extend from the center of sidewalls 23 to the center of sidewall 25. A handle 45 extends upwardly from the partitions 41, 43, and may be provided with an opening 46 to facilitate grasping the handle to move the dispenser 10 about. If the dispenser 10 is fabricated of wood, which results in an attractive unit well suited in appearance for countertop display in a kitchen, the partitions 40, 42 and the partitions 41, 43 may be fabricated of single pieces which are slotted to be assembled into the cross configuration illustrated. If the dispenser is fabricated of plastic, the base, sidewalls, partitions and handle may be integrally formed.

The dispenser 10 further comprises stop means in the form of a lid 50 of the housing 20, which is square when viewed in plan and dimensioned to cover the upper ends of the sidewalls 22–25. The lid 50 defines an elongated slot opening 51 whereby the lid 50 may be fitted over the handle 45, and the engagement of the lid 50 with the handle 45 at the lid slot 51 maintains the lid squared with the sidewalls. The lid 50 may also be provided with depending stub shafts, such as stub shaft 52, which are positioned generally centrally with respect to the four compartments defined by the housing 20. The stub shafts are received in the cardboard support tubes of the rolls of sheet goods 12–15.

Figure 4:
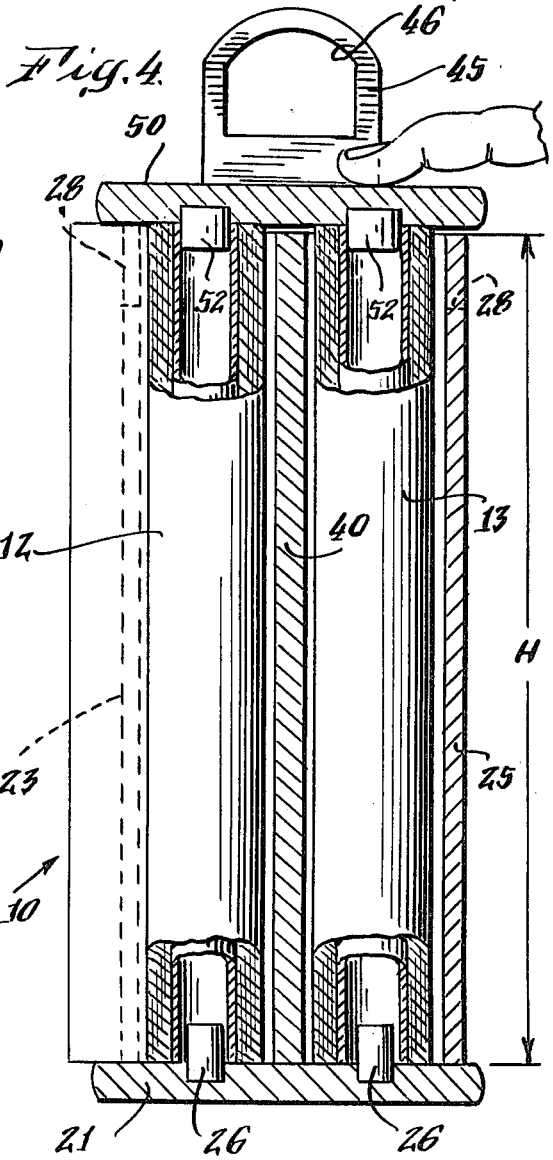
FIG. 4 is a vertical sectional view of the dispenser of FIG. 1 taken along the lines 4—4 of FIG. 2.
Figure 3:
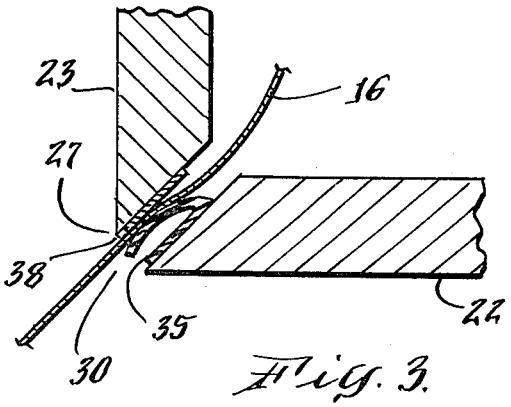
FIG. 3 is an enlarged cross-sectional view of a corner of the dispenser of FIG. 1.

The rolls of sheet goods 12–15 may include such items as wax paper, aluminum foil, self-adhering food wrap (Saran® wrap), plastic bags (Baggies® food storage bags), and the like. These rolled sheet goods are provided from their manufacturers in standard widths, usually twelve inches. The rolls of sheet goods 12–15 are oriented vertically in the housing 20, whereby the width of the roll becomes its "height". The height H of the sidewalls 22–25 of the housing is slightly less than the height of the rolls of sheet goods in their vertical orientation, e.g. the height H of the sidewalls 22–25 may be approximately $11\frac{7}{8}$ inches to 11 15/16 inches in the embodiment shown. Thus, the lid 50, when installed over the handle 45, rests on the ends of the rolls of sheet goods 12–15, as best seen in FIG. 4. Alternatively, the height of the sidewalls 22–25 may be somewhat greater than the height of the rolls of sheet goods in their vertical orientation, and the lid can have depending areas which extend into the housing and rest on the ends of the rolls of sheet goods.

The ends of the sheet goods are fed into the slots 30–33, a respective one of which provides an exit from each of the four compartments defined by the housing 20. In the preferred dispenser 10 shown, a flexible V-shaped clamping strip 35, best seen in FIG. 3, has one leg mounted to the beveled side surface of the sidewall 21 with the free leg lightly clamping the sheet goods 16 of the roll of sheet goods 12 to the beveled side surface of the sidewall 23. The sheet goods can be pulled past the clamping strip 35 through the slot 30 easily, but the clamping strip 35 prevents the sheet goods from slipping back into the housing. The other slots are also preferably provided with clamping strips. The sidewalls 22–25 are further preferably provided with rounded cutouts intersecting the slots, such as cutout 28 intersecting slot 30, best seen in FIG. 1. This provides access for gripping the sheet goods 16. The outer edge 27 of the sidewall 23 may be sharp to cut or separate the sheet goods, or a serrated metal cutter 39 may be mounted on the beveled side edge of the sidewall 23 to provide a better cutting surface.

The dispenser 10 is used in the following manner. First, the rolls of sheet goods 12–15 are inserted one each into the four cavities defined by the housing 20, and the sheet goods are threaded into the slots 30–33. The lid 50 is then fitted over the handle 45. A selected one of the sheet goods is grasped at the rounded cutout intersecting its exit slot, and a desired amount of sheet goods is pulled through the slot. After the desired amount of sheet goods is withdrawn from the housing, pressure is applied to the lid 50, such as by pushing on the lid as illustrated in FIG. 4. The lid funtions a stop means, clamping the roll of sheet goods between the lid and base of the dispenser. This prevents any further amount of the sheet goods from unrolling and permits the sheet goods to be tensioned and torn off at the edge of the slot. Once the sheet goods have been torn off, the cut end of the sheet goods remains available in the slot for the next use thereof.

Figure 5:
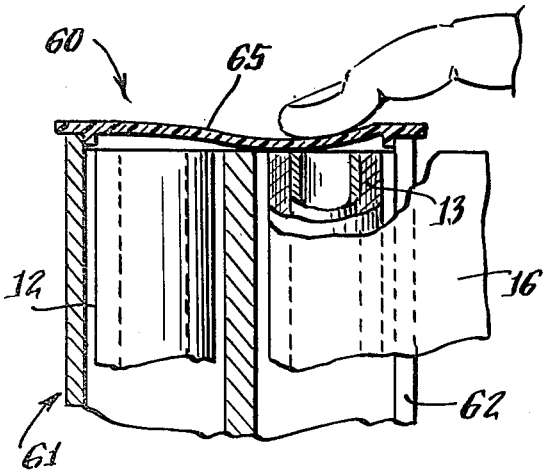
FIG. 5 is a fragmentary vertical sectional view of another dispenser of rolled sheet goods according to the invention herein.

With reference to FIG. 5, another dispenser 60 for rolled goods according to the invention herein is illustrated. The dispenser 60 may be quite similar to the dispenser 10 described above, generally comprising a housing 61 with vertical sidewalls defining exit slots for rolled sheet goods which are oriented vertically within the housing 61. A lid 65 of the housing 61 is made of a resilient material, such as plastic, whereby the lid 65 functions as a stop means by being flexed downwardly to engage the end of the selected one of the rolled sheet goods, thereby stopping the roll from turning and preventing the sheet of rolled goods withdrawn from the housing to be tensioned and torn off.

Figure 6:
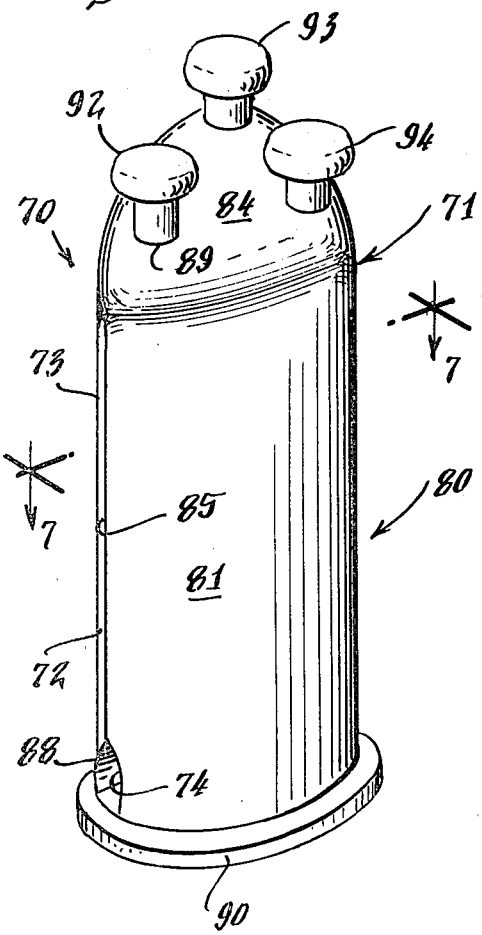
FIG. 6 is a perspective view of another dispenser for rolled sheet goods according to the invention herein.
Figure 7:
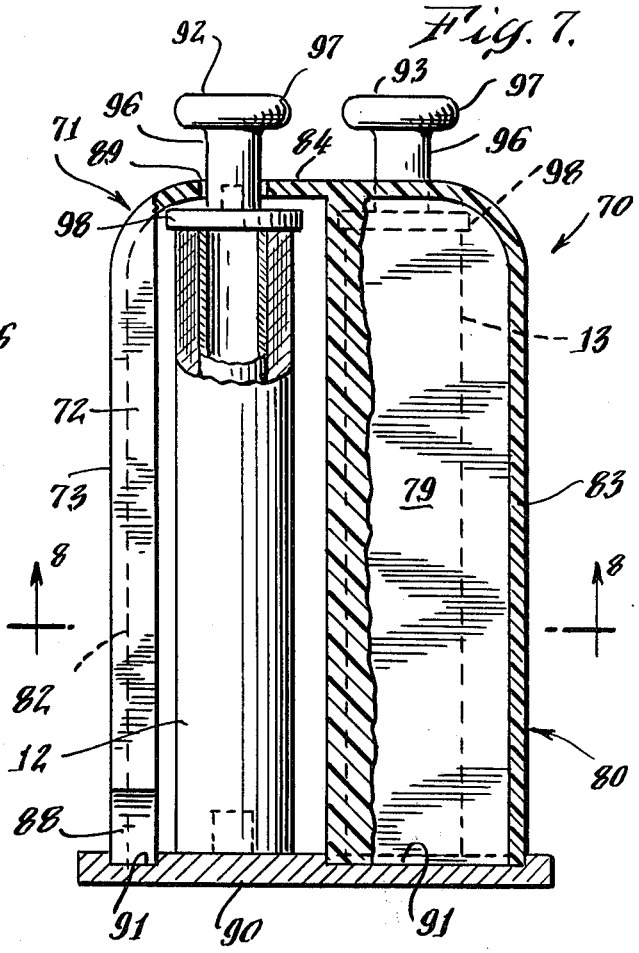
FIG. 7 is a sectional view of the dispenser of FIG. 6 taken along the lines 7—7 of FIG. 6.
Figure 8:
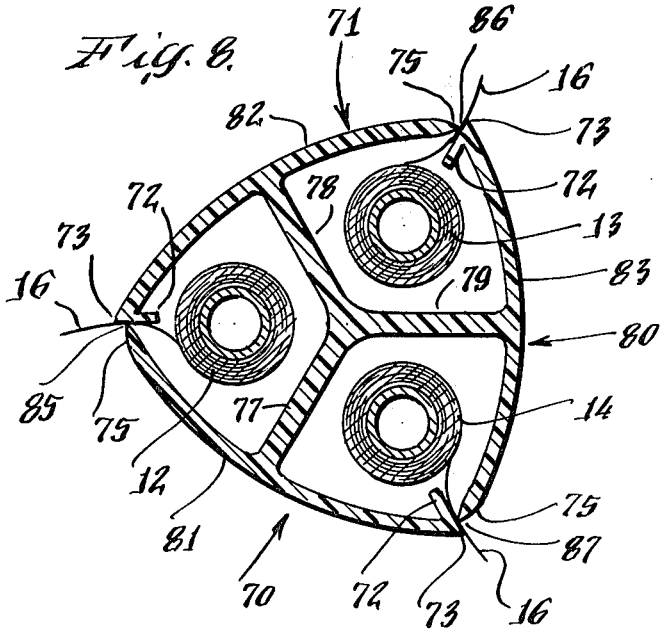
FIG. 8 is a cross-sectional view of the dispenser of FIG. 6 taken along the lines 8—8 of FIG. 7.

Another dispenser 70 for rolled sheet goods according to the invention herein is illustrated in FIGS. 6–8. The dispenser 70 comprises a housing 80 in the general form of an elongated cap 71 which is received on a base 90, the housing 80 having floating depressible stops for engaging rolls of sheet goods 12–14 received within the housing. The dispenser 70 is well adapted for fabrication from plastics or the like, which will be apparent in the further description thereof.

The housing 80 of the dispenser 70 comprises an elongated triangular cap 71 having sidewalls 81–83 and a top 84. The sidewalls 81–83 are connected by interior partitions 77–79, which both support the sidewalls and divide the interior of the housing into elongated compartments. A triangular configuration is illustrated for the dispenser 70 and accordingly the partitions divide the interior into three elongated compartments each respectively receiving one of the rolls of sheet goods 12–14 in vertical orientation.

Vertical slots 85–87 are defined between the sidewalls 81–83. With particular reference to FIG. 8, the slot 85 is defined between an inwardly extending leg 72 of the sidewall 82, whereby the sheet goods 16 coming off of the roll of sheet goods 12 passes over the flat surface of the leg 72. The edge 73 of the sidewall 82 at its intersection with the leg 72 may be sufficiently sharp to cut or separate the sheet goods or alternatively a metal serrated cutter may be mounted on the leg 72 for that purpose. The marginal edge 75 of the sidewall 81, which also defines the slot 85, is preferably somewhat flexible and self-biasing against the leg 72 of the sidewall 82, e.g. the marginal edge thinner than the remainder of sidewall 82. Thus, the sheet goods are lightly clamped in the slot to prevent the sheet goods from slipping back into the housing. The other slots 86 and 87 may be similarly constructed. The sidewalls are provided with rounded openings, e.g. openings 74 and 88, best seen in FIG. 6, the rounded openings flanking and intersecting the vertical slots to expose an area of the sheet goods for grasping the sheet goods and withdrawing them from the dispenser 70. The rounded openings are preferably formed at the bottom of the sidewalls, for ease of molding.

The cap 71 detachably mounts to a base 90 of the dispenser 70 and more particularly the base 90 may define a groove generally indicated at 91 and best seen in FIG. 7, which receives the lower marginal edges of the sidewalls 81–83 and the partitions 77–79. Thus, the cap 71 is inverted to load the rolls of sheet goods therein and thereof the ends of the sheet goods through the slot. The base is thereafter mounted to the cap 71, and the assembled dispenser 70 is then turned over to place its base 90 on a countertop, a table or the like for use.

The housing 80 is provided with three floating stops 92–94 one stop for each of the three compartments and the rolls of sheet goods 12–14 received therein. More particularly, and as best seen in FIG. 7, the floating stop 92 has a shaft 96 which is inserted through an opening 89 in the top 84 of the housing. An enlarged head 97 is provided at the upper end of the shaft 96, and an enlarged disc 98 is mounted to the lower end of shaft 96 within the housing, whereby the stop 92 may float up and down but is constrained on the housing. The disc 98 rests on the end of the roll of sheet goods, whereby the application of pressure on the head of the floating stop 92 serves to clamp the roll of sheet goods between the stop 92 and base 91 of the dispenser 70.

When it is desired to dispense a selected one of the rolled sheet goods, its end is grasped at the rounded openings provided flanking its exit slot, and a desired amount of sheet goods is pulled from the housing. Pressure is then applied to the floating stop associated with the roll of sheet goods, preventing further unrolling of the sheet goods and permitting tensioning of the sheet goods so that it can be torn off against the sharp edge of the slot or the metal serrated cutter provided at the edge of the slots.

It will be appreciated that certain features of the dispensers 10 and 60 described above could be incorporated into or modify the structure of the dispenser 70. For instance, the floating stops 92–94 of dispenser 70 could be deleted by making the top 84 of the cap 81 sufficiently flexible to function as stop means, e.g. the top 84 up on application of pressure would deflect into contact with the end of the rolls of sheet goods to prevent them from turning. The top 84 and base 90 of dispenser 70 could also be provided with stub shafts to better locate the rolls of paper goods.

Accordingly, there have been described dispensers for rolled sheet goods which admirably achieve the objects of the invention herein. It will be appreciated that the embodiments described are illustrative of the invention but do not limit it and that those skilled in the art will be able to make modifications to the embodiments described without departing from the spirit and scope of the invention, which is limited only by the following claims.

I claim:

1. A dispenser for rolled sheet goods comprising:

(A) a housing adapted to receive and enclose a plurality of rolls of sheet goods in vertical orientation, the housing defining a vertical slot for each roll of sheet goods received and enclosed therein through which sheet goods from each of the rolls of sheet goods may be withdrawn; and (B) stop means at the top of the housing for engaging the upper end of the rolls of sheet goods upon application of pressure to said stop means, thereby preventing the sheet goods from unrolling when the stop means are engaged;

whereby the desired amount of sheet goods from a selected one of the rolls of sheet goods may be withdrawn through its respective slot and pressure is applied to the stop means to prevent additional sheet goods from being withdrawn through the slot as the sheet goods are held in tension and torn off at the edge of the slot.

2. A dispenser for rolled sheet goods as defined in claim 1 wherein the housing comprises a flat base and vertical sidewalls upstanding therefrom, and the stop means comprises a flexible lid received on the upper ends of the vertical sidewalls and disposed over the ends of the rolls of sheet goods, whereby upon application of pressure the flexible lid deflects into contact with the rolls of sheet goods to prevent additional sheet goods from being withdrawn from the housing.

3. A dispenser for rolled sheet goods as defined in claim 1 wherein the housing defines an opening intersecting the exit slot, said opening providing access for grasping the end of the sheet goods.

4. A dispenser for rolled sheet goods as defined in claim 1 wherein the housing comprises an elongated cap having a top and depending sidewalls and a base receiving the lower ends of the depending sidewalls of the cap, wherein the stop means comprises one floating stop for each roll of sheet goods received and enclosed in the housing, each floating stop extending through the top of the cap and resting on the end of a roll of sheet goods, whereby application of pressure to the floating stop clamps the roll of sheet goods between the floating stop and the base to prevent the roll of sheet goods from turning.

5. A dispenser for rolled sheet goods as defined in claim 1 wherein the housing comprises an elongated cap having a top and depending sidewalls and partitions dividing the cap into a plurality of compartments, each compartment receiving one roll of sheet goods, and a base receiving the lower ends of the depending sidewalls of the cap and the stop means comprises a flexible portion of the top of the elongated cap which deflects into contact with the upper end of the rolls of sheet goods upon application of pressure thereto.

6. A dispenser for rolled sheet goods comprising:

(A) a housing having a plurality of sidewalls arrayed in a polygonal shape and adapted to receive a number of rolls of sheet goods equal to the number of sidewalls of the housing, the housing defining one vertical slot for each roll of sheet goods received and enclosed therein through which the rolls of sheet goods may be respectively withdrawn; and (B) stop means at the top of the housing for engaging the upper ends of the rolls of sheet goods upon application of pressure to said stop means, thereby preventing the sheet goods from unrolling when the stop means are engaged, whereby the desired amount of sheet goods from a selected one of the rolls of sheet goods may be withdrawn through its respective slot and pressure may be applied to the stop means to prevent additional sheet goods from being withdrawn through the slot as the sheet goods are held in tension and torn off at the edge of the slot.

7. A dispenser for rolled sheet goods as defined in claim 6 wherein the vertical slot through which the sheet goods may be withdrawn has a flexible clamp mounted therein to maintain the end of the sheet goods within the slot and available for grasping and withdrawing further sheet goods from the dispenser.

8. A dispenser for rolled sheet goods as defined in claim 7 wherein the flexible clamp comprises a flexible edge of the housing defining the vertical slot.

9. A dispenser for rolled sheet goods as defined in claim 6 wherein a plurality of vertical slots are defined between adjacent sidewalls of the housing.

10. A dispenser for rolled sheet goods as defined in claim 9 wherein the housing comprises a flat base and vertical sidewalls upstanding therefrom, and the stop means comprises a lid of the housing which rests on the ends of the rolls of sheet goods and, upon application of the pressure to said lid, clamps at least a selected one of the rolls of sheet goods between the lid and base to prevent the roll of sheet goods from turning.

11. A dispenser for rolled sheet goods as defined in claim 10 wherein the housing further comprises a handle extending through a slot opening defined in the lid, the handle preventing the lid from rotating with respect to the sidewalls and facilitating moving the dispenser from place to place.

12. A dispenser for rolled sheet goods as defined in claim 11 and further comprising flexible clamps respectively mounted in the vertical slots to lightly clamp the end of the sheet goods within the vertical slots, thereby maintaining the ends of the sheet goods available for grasping and dispensing additional sheet goods from the rolls thereof.

13. A dispenser for rolled sheet goods as defined in claim 6 wherein the housing further comprises partitions dividing the housing into a plurality of compartments, each compartment receiving one roll of sheet goods.

14. A dispenser for rolled sheet goods as defined in claim 6 wherein the housing includes a plurality of stub shafts which are received in and support the support tubes of the rolled sheet goods to position the rolled sheet goods in the housing.

15. A dispenser for rolled sheet goods as defined in claim 6 wherein the housing comprises a flat base and vertical sidewalls upstanding therefrom, and the stop means comprises a lid of the housing which rests on the ends of the rolls of sheet goods and, upon application of the pressure to said lid, clamps at least a selected one of the rolls of sheet goods between the lid and base to prevent the roll of sheet goods from turning.

16. A dispenser for rolled sheet goods as defined in claim 15 wherein the housing further comprises a handle extending through a slot opening defined in the lid, the handle preventing the lid from rotating with respect to the sidewalls and facilitating moving the dispenser from place to place.

17. A dispenser for rolled sheet goods as defined in claim 16 and further comprising flexible clamps respectively mounted in the vertical slots to lightly clamp the end of the sheet goods within the vertical slots, thereby maintaining the ends of the sheet goods available for grasping and dispensing additional sheet goods from the rolls thereof.

18. A dispenser for rolled sheet goods as defined in claim 6 wherein the housing defines an opening intersecting the exit slot, said opening providing access for grasping the end of the sheet goods.

* * * * *